United States Patent [19]

Wieczorek

[11] Patent Number: 4,583,708

[45] Date of Patent: Apr. 22, 1986

[54] HANGER EQUIPMENT FOR PRINTED MATTER SUCH AS TELEPHONE DIRECTORIES

[75] Inventor: Casey J. Wieczorek, Basking Ridge, N.J.

[73] Assignee: AT&T Technologies, Inc., Berkeley Heights, N.J.

[21] Appl. No.: 572,484

[22] Filed: Jan. 20, 1984

[51] Int. Cl.[4] ..... B42D 17/00

[52] U.S. Cl. ..... 248/447; 312/233; 281/45; 402/72; 16/76

[58] Field of Search ..... 248/447, 293, 145; 312/233, 27; 281/45, 46, 47; 402/70, 72; 16/76

[56] References Cited

U.S. PATENT DOCUMENTS

| | | | |
|---|---|---|---|
| 1,925,945 | 9/1933 | Zielinski | 16/76 |
| 2,936,143 | 5/1960 | Anderson | 248/145 |
| 3,275,279 | 9/1966 | Caldwell | 312/233 |
| 3,658,284 | 4/1972 | Haasl | 248/145 |
| 3,908,954 | 9/1975 | Nix | 248/447 |
| 3,918,672 | 11/1975 | Torn | 248/447 |
| 4,254,929 | 3/1981 | Popper, Jr. | 248/447 |
| 4,323,290 | 4/1982 | Hickman | 248/447 |

OTHER PUBLICATIONS

Phonebooth Accessories, Inc., "A Protected Directory Facility", publication date unknown, however acknowledged as prior art by applicant.

Phillips & Brooks, Inc., "Swingaway Directory Facilities", publication date unknown, however acknowledged as prior art by applicant.

*Primary Examiner*—J. Franklin Foss

*Assistant Examiner*—Robert A. Olson

*Attorney, Agent, or Firm*—R. F. Kip, Jr.; J. F. Spivak

[57] ABSTRACT

A vertical support shaft projects down from the underside of a telephone booth shelf and supports the inner end of an arm swivelable horizontally about the shaft. The outer end of the arm is hingedly coupled to a telephone directory binder so that the binder is pivotable about a horizontal axis at such end and transverse to the arm's centerline. The binder's centerline is parallel to a reference line passing through such axes at an acute angle b. When the arm is on "in" position the binder is stored beneath the shelf in primary alignment with its width. When the arm is pulled out and the binder is pivoted out, up and over, the binder goes through a motion equivalent to an angular displacement of 2b to come to rest face-up with an alignment parallel to its former widthwise alignment.

The shaft also mounts the inner end of another arm hingedly coupled at its outer end to two telephone directory binders each stored beneath the shelf in alignment with its length, and each adapted upon outward swiveling of such arm and pivoting of that binder to come to rest in a face-up position.

2 Claims, 5 Drawing Figures

HANGER EQUIPMENT FOR PRINTED MATTER SUCH AS TELEPHONE DIRECTORIES

TECHNICAL FIELD

This invention relates generally to installations and mechanisms for holding or hanging printed matter in the form of printed volumes (i.e., sets of printed sheets) to be movable from a suspended stored position to a face-up "read" position making the printed matter easily readable. More particularly, this invention relates to installations and mechanisms of such kind for so holding telephone directories, and the invention will be disclosed herein with that application in mind although not being limited thereto.

BACKGROUND OF THE INVENTION

Telephone directory holding equipment has long been in use in telephone booths and otherwise in association with telephone sets. In one well known "pivot-only" type of equipment, a set of binders with telephone directories therein is suspended in a central well in a raised platform from a horizontal pin shaft extending across the top of the well midway between its front and back. Each binder and directory is independently pivotable about such shaft to be movable solely by that pivoting from a stored position in the well to a face-up reading position.

In another directory hanging equipment of the "swivel and pivot" type (commonly used in telephone booths), a carrier arm is mounted below a shelf of the booth by means coupling the inner end of the arm to the underside of the shelf to permit swiveling of the arm in a horizontal plane. One or two binders with telephone directories therein are coupled to the outer end of the arm by hinge means permitting pivoting of the one or two binders about a horizontal axis at the arm's free end and disposed transverse to its centerline. Normally, the arm extends from its pivot lengthwise of the shelf to suspend and store the binder(s) and directory(ies) beneath the shelf. When, however, it is desired to read a directory, the arm is swiveled so that its outer end is positioned outward of the shelf's front, and the binder for that directory is then pivoted outward, upward and over from its suspended stored position to a position at which the binder is supported from underneath by the arm and is face-up and may be opened to permit reading of the directory therein.

Telephone directory holding equipments of the types described above have certain practical limitations. For example, equipments of the "pivot-only" type are not particularly convenient for use in confined spaces such as is afforded by telephone booths. On the other hand, while swivel-and-pivot equipments are well adapted for telephone booth usage, up to now such equipments have not been suited for handling more than two binders and directories.

SUMMARY OF THE INVENTION

One or more of the mentioned or other limitations of prior holding equipments for printed matter such as telephone directories are overcome by the invention in a manner as follows. The invention in one of its aspects takes the form of a printed matter hanger mechanism comprising a base securable to the underside of raised support means, a horizontal arm below said base, and coupled thereto at the arm's inner end by swivel means permitting pivotal horizontal movement of the arm about such end, and a printed matter binder coupled to the arm's outer end by hinge means permitting the binder to pivot about a horizontal axis at such end and transverse to the arm's centerline so that the binder is movable between stored and face-up positions about 180° apart at which, respectively, the binder hangs from the arm and the binder is supported from underneath by the arm and is openable to permit reading of the printed matter therein. The mentioned hinge means maintains the centerline of the binder parallel to a reference line intersecting the mentioned horizontal axis at an acute angle b and rotatable about such axis as the binder rotates thereabout. The result is that binder movement between its said two positions produces an angular displacement of $2b$ between such axis and the projection of that centerline onto a horizontal plane through that axis. Such angular displacement featue permits the binder to be stored beneath a shelf or other support means widthwise of such means to thereby conserve storage space in its lengthwise direction while, at the same time, the advantages in the use of a swivel-and-pivot type of hanging mechanism may be obtained. Moreover, such a mechanism with the described angular displacement feature may be used in a hanger installation in combination with a more conventional swivel-and-pivot hanger mechanism to permit storage beneath the upport means of one or more directories aligned with the width of the support means and one or more directories aligned with the length thereof.

The invention in another of its aspects takes the form of a hanger mechanism comprising a base of the kind described, and two swivel arms disposed below such base, one above the other, with their inner ends superposed such that a common vertical axis passes through both such ends. Both arms are coupled to such base by swivel means to be independently pivotally movable about such axis in respective horizontal planes. At least one binder is coupled through hinge means to the outer end of each such arm to be movable through about 180° between stored and face-up positions. Such hanger mechanism provides the advantage of permitting the use of multiple binder carrying arms while not requiring more than one vertical swivel axis for the arms so as, thereby, to simplify the swivel means and to conserve the space needed for storage of the binders carried by the arms.

BRIEF DESCRIPTION OF DRAWINGS

These and other aspects of the invention will be better understood from the following description of an exemplary embodiment thereof, and from the accompanying drawings wherein.

DETAILED DESCRIPTION OF EMBODIMENT

Figure 1:
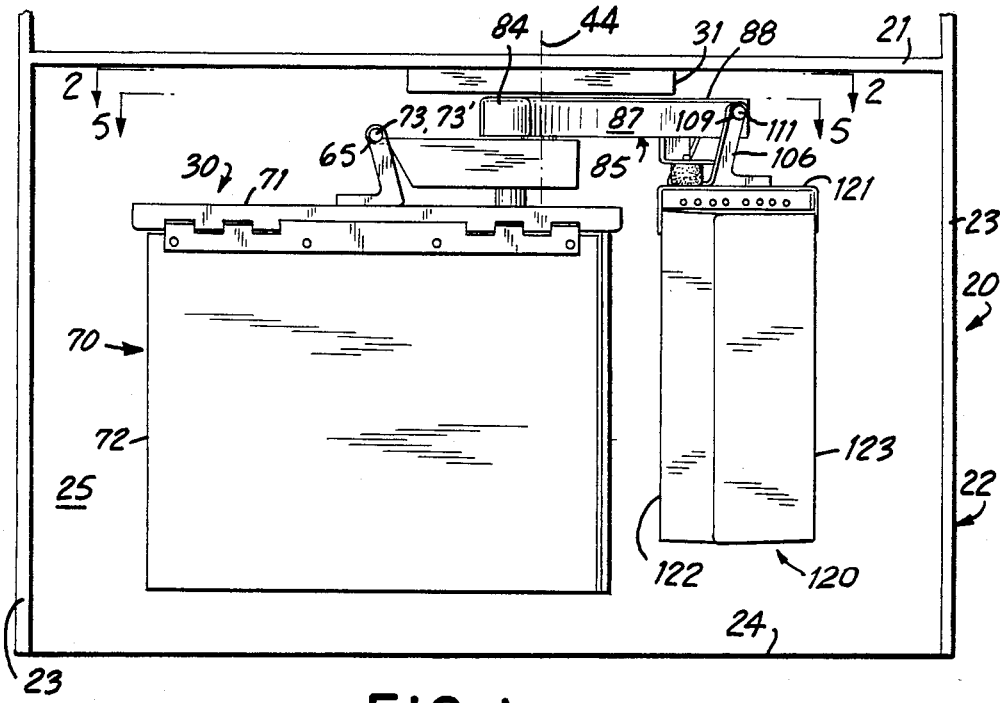
FIG. 1 is a front elevation of a telephone directory hanger installation according to the invention.

Referring now to FIGS. 1–4, the reference numeral 20 (FIG. 1) generally designates a telephone directory hanger installation including support means 21 in the form of a shelf disposed inside a telephone booth 22 so as to be secured at its opposite longitudinal ends by the side walls 23 of the booth and to be raised above the booth's floor 24. Shelf 21 has beneath it a storage space 25 of which the length and width dimensions are indicated by the dotted line rectangle 26 (FIG. 2), the length direction being that in which side walls 23 are separated from each other. Support means 21 may be other than such a shelf. Thus, for example, support means 21 may also be at the top of a telephone directory hanger installation outside a telephone booth.

Beneath shelf 21 is a telephone directory hanger mechanism 30 comprising a base 31 secured to the underside of the shelf by screws 32 passing upward through holes in the base and into the shelf. Base 31 is in the form of a plate which has formed in its top a groove 33 disposed between the front and back edges of the plate (closer to the front edge) and extending longitudinally all the way across the plate. Seated in groove 33 and secured to plate 31 by welding is the head 34 of a stationary vertical support shaft 35 passing through an aperture 36 (FIG. 4) in the plate to extend downwardly therefrom.

The bottom end of shaft 35 is contained within an annular cylindrical stationary bushing 37 fixedly secured to shaft 35 by a pin 38 passing from one side to the other of the bushing and shaft through holes formed in those elements. The top and bottom ends of bushing 37 have annular grooves 39, 40 of "L" cross section formed therein. Seated in these grooves are a pair of washer type thrust bearings 41, 42 constituted of fibrous material impregnated with TEFLON®. An arm 45 is mounted at its inner end by bearings 41, 42 so that the arm can swivel about the vertical axis 44 of shaft 35 while being constrained from any substantial up and down movement by those bearings.

Arm 45 is a "broad" arm formed of an assembly comprising a platform 46 of upside-down rectangular "U" cross section having back and front vertical side walls 47 and 47′ and a top horizontal web 48 joining these side walls. The back of the upside down "U" opening of platform 46 is closed by a U-channel member 49 received and extending between side walls 47, 47′ of platform 46 and having its channel facing inwardly towards the outer end of the platform. Member 49 is constituted of a horizontal upperside wall 50 welded to the underside of web 48, a lower horizontal sidewall 51 and a vertical web 52 joining sidewalls 50 and 51.

The web 48 and the sidewalls 50, 51 all have registering apertures formed therein for passage therethrough of the shaft 35, and such apertures fit around the shaft with a close fit to couple shaft 35 and arm 45 by bearing means which permits swiveling of the arm in the horizontal plane while preventing significant angular movement of the arm in its other angular coordinates. Limits are set to such swiveling movement by a stop means 53 in the form of a stationary cam fixedly fastened to bushing 37 to project outward from that bushing. When arm 45 is in its position shown in FIG. 2, one vertical side edge of cam 53 bears against the front wall 47 of the platform to prevent further clockwise rotation of the arm about axis 44. When, on the other hand, arm 45 is swiveled counterclockwise (FIG. 2) about that axis to a position at which it is about 90° angularly displaced from its shown FIG. 2 position, another vertical side edge of cam 53 comes to bear against vertical web 52 to prevent further counterclockwise movement of the arm.

Attached to the underside of lower side wall 51 of arm 45 are a pair of transversely spaced rubber bumpers 55, 55′ secured to such wall by rivets 56.

Arm 45 has at its outer end a pair of hinge knuckles 60 and 60′ for providing hinge couplings between that arm and a pair of hangers 61, 61′ each comprising (FIGS. 1 and 2) a planar foot 62, two side pieces 63, 64 of acute angle "L" shape which are integral with foot 62 and project normally therefrom on transversely opposite sides thereof, and also, apertures 65 formed in the tops of such side pieces. The hinge couplings between arm 45 and such hangers are effected by hinge pins 66, 66′ passing through the apertures in the hanger side pieces and through the hinge knuckles 60, 60′.

Figure 2:
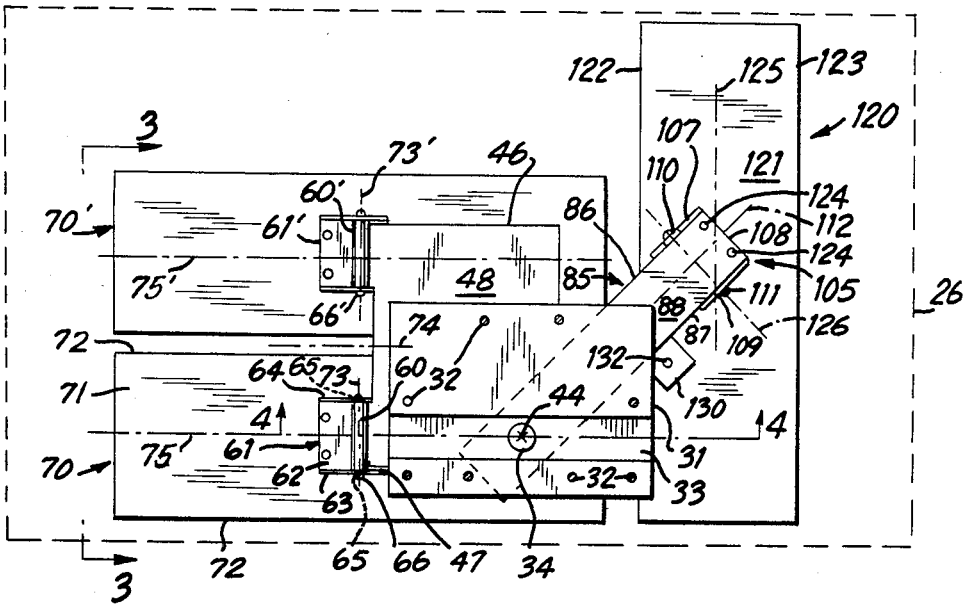
FIG. 2 is a cross-sectional plan view taken as indicated by the arrows 2—2 in FIG. 1; such view showing the hanger mechanism of the FIG. 1 installation.
Figure 3:
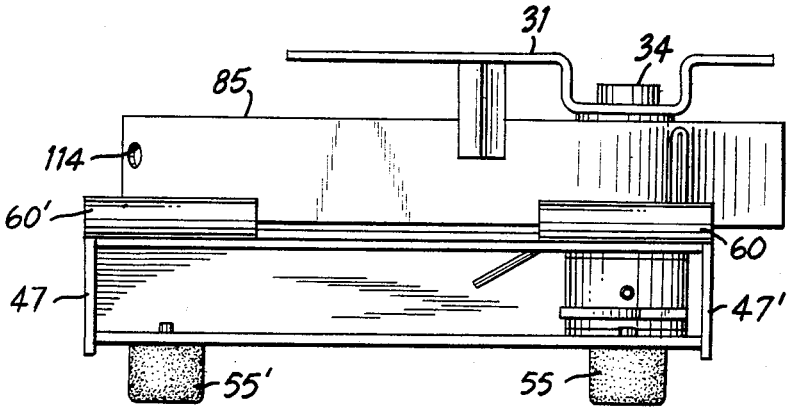
FIG. 3 is a left-side elevation of such mechanism with certain of its parts removed.
Figure 4:
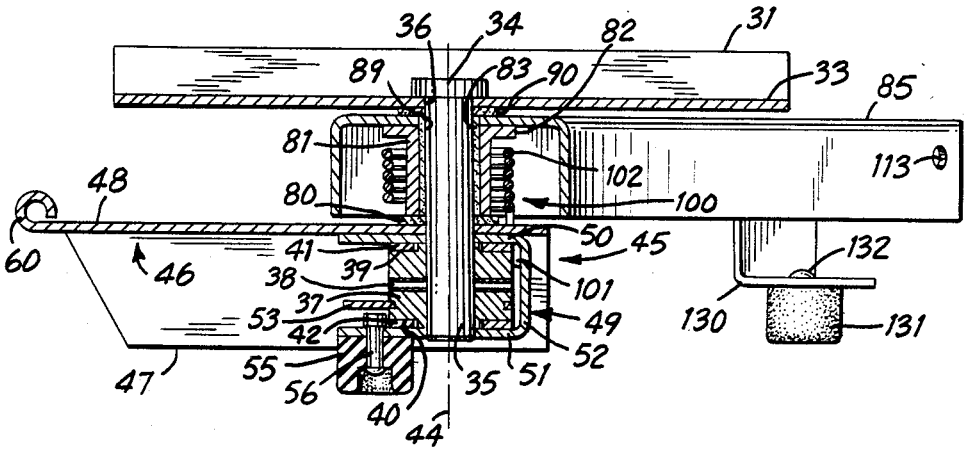
FIG. 4 is a cross-section through the FIG. 3 mechanism, taken as indicated by the arrows 4—4 in FIG. 2.

The foot 62 of hanger 61 is attached to a telephone directory binder 70, comprising a spine 71 and hard covers 72, 72, by screws 73 passing through foot 62 and into such spine. A duplicate binder 70′ is similarly attached to hanger 61′. Each of binders 70 and 71′ is adapted to retain therein in a conventional manner a telephone directory. As shown in FIGS. 1 and 2, the orientation between hangers 61, 61′ and directories 70, 70′ and, also, the couplings of the directories to arm 45 by elements 60, 60′, 61, 61′ and 66, 66′, are all such as to provide hinge means which (a) maintains the centerlines 75, 75′ of the spines of the directories at right angles to the respective axes 73, 73′ of the hinge pins 66, 66′ (such pin axes being at the outer end of arm 45 and being disposed transverse to its centerline 74), and which (b) permits each of such binders to be pivoted about the corresponding pin axis between positions which are about 180° apart and, at which, respectively, the binder is suspended from arm 45 and the binder is face-up and is supported from underneath by that arm.

Returning to FIG. 4, above arm 45 and around shaft 35 is a washer type thrust bearing 80 similarly constituted to bearings 41, 42. Above bearing 80 is a rotatable bushing 81 having a flanged head 82 at its top and having in its bore a sleeve type bearing 83 constituted of fibrous material impregnated with TEFLON and within which shaft 35 is journaled. Bushing 81 and bearing 83 provide a swivel mounting means for a "narrow" arm 85 of an upside down "U" cross section so as to have vertical side walls 86, 87 joined by a horizontal web 88. Bushing head 82 is welded to the underside of web 88 at the inner end of arm 85, and the web has at such end an aperture 89 therein for reception of the top of bearing 83 and for passage through the web of the shaft 35. Arm 85 also has a back wall 84 which projects as a flap down from web 88, and which closes the back end of the "U" channel defined by arm 85. Another washer type thrust bearing 90 (similarly constituted to bearings 41 and 42) is disposed around shaft 35 above arm 85 between that arm and the underside of groove 33 in base plate 31.

The bushing 81 and bearing 83 together constitute bearing means which couples arm 85 to shaft 35 to permit swiveling of the arm in the horizontal plane about the shaft's axis 44 while constraining angular movement of the arm in its other angular coordinates. Limits are set to such swiveling of arm 85 by stop means 95 in the form of a stub bar 95 (FIG. 5) welded to plate 31 to project downward therefrom into the path of movement of the arm. When, on the one hand, arm 85 is in its position shown in FIG. 2, bar 85 bears against the arm's side wall 86 at a point therein forward of axis 44 (i.e., at a point displaced from axis 44 toward the outer end of the arm) to prevent further counterclockwise rotation of the arm. When, on the other hand, arm 85 is rotated clockwise about 90° from its shown FIG. 2 position, such rotation brings sidewall 86 into contact with bar 95 at a point on the sidewall rearward of axis 44 so as, by such contact, to prevent further clockwise rotation of arm 85.

Disposed around bushing 81 is a torsion spring 100 having lower and upper terminating ends 101 and 102. End 101 passes through a hole (not shown) in the web 48 of lower arm 45 to bear against the back wall 52 of that arm. End 102 comes out to the front of the plane of the drawing of FIG. 4 to bear against the back wall 84 (FIG. 1) of the upper arm 85. Spring 100 is wound to be in torsion so as to tend to unwind. Accordingly, spring 100 urges upper arm 85 to rotate counterclockwise (FIG. 2) and lower arm 45 to rotate clockwise so that, under such urging, arms 85 and 45 bear against stops 53 and 95, respectively, to be held in position (and prevented from further rotation) by those stops. With lower arm 45 being so held in position by stop 53, upper arm 85 can be swiveled away from its counterclockwise limiting position (determined by stop 95) to undergo clockwise rotation against the bias of spring 100 until arm 85 reaches its clockwise limiting position (again determined by stop 95). Conversely, with upper arm 85 bearing at its counterclockwise limiting position against stop 95, lower arm 45 can be swiveled away from its clockwise limiting position (determined by stop 53) to undergo counterclockwise rotation against the bias of spring 100 until arm 45 reaches its counterclockwise limiting position (again determined by stop 53).

Upper arm 85 carries (FIGS. 1 and 2) at its outer end a hanger 105 similar in most respects to hangers 61, 61' in that that hanger comprises a pair of acute angle "L" shaped side pieces 106, 107 integral with and joined at their bottoms to a planar foot 108 on opposite sides of the foot, the tops of the side pieces having respective transverse apertures 109, 110 formed therein. Arm 85 at its outer end is disposed between those side pieces. The coupling of the hanger to the arm is accomplished by a hinge pin 111 passing horizontally transverse to the centerline 112 of arm 85 through apertures 109, 110 of the hanger and through apertures 113, 114 formed in the side walls 86, 87 of arm 85.

Attached to hanger 105 is a telephone directory binder 120 comprising a spine 121 and hard covers 122, 123, the binder being adapted to retain a telephone directory therein. Binder 120 is secured to the hanger by screws 124 passing through holes in the hanger's foot 108 and into the spine 121 of the binder. As distinct from the orientation of binders 70, 70' in relation to the centerline 74 of their carrier arm 45, in the case of binder 120, it is secured in such manner to hanger 105 that the centerline 125 of the binder's spine 121 is at an acute angle to the horizontal axis 126 which is the axis of pin 111, and which is disposed transverse to centerline 112 of arm 85. The significance of such acute angle will be later discussed in more detail. Suffice it to say for now that hanger 105 and pin 111 provide a hinge means for coupling binder 120 to arm 85 so that the binder is pivotally movable about axis 126 between positions of the binder which are about 180° apart, and at which, respectively, the binder is suspended from the arm, and the binder is supported from underneath by the arm to be face-up and openable to permit the reading of a telephone directory in the binder.

Side wall 87 of arm 85 has at its bottom an "L" shaped tab 130 integral with the wall and projecting downwardly and then horizontally outward. The lower horizontal part of tab 130 supports a rubber bumper 131 secured to the underside of such part by a rivet 132. The center of gravity of binder 120 is slightly forward of the center of hinge pin 111. Accordingly, when that binder is suspended from arm 85, the weight of the binder and the directory therein will produce a small moment causing the binder to bear against bumper 131 and thus be stabilized in position. For the same reason, binders 70 and 71' will, when suspended, bear against their respective bumpers 55, 55' to be stabilized in position.

USE OF EMBODIMENT

Figure 5:
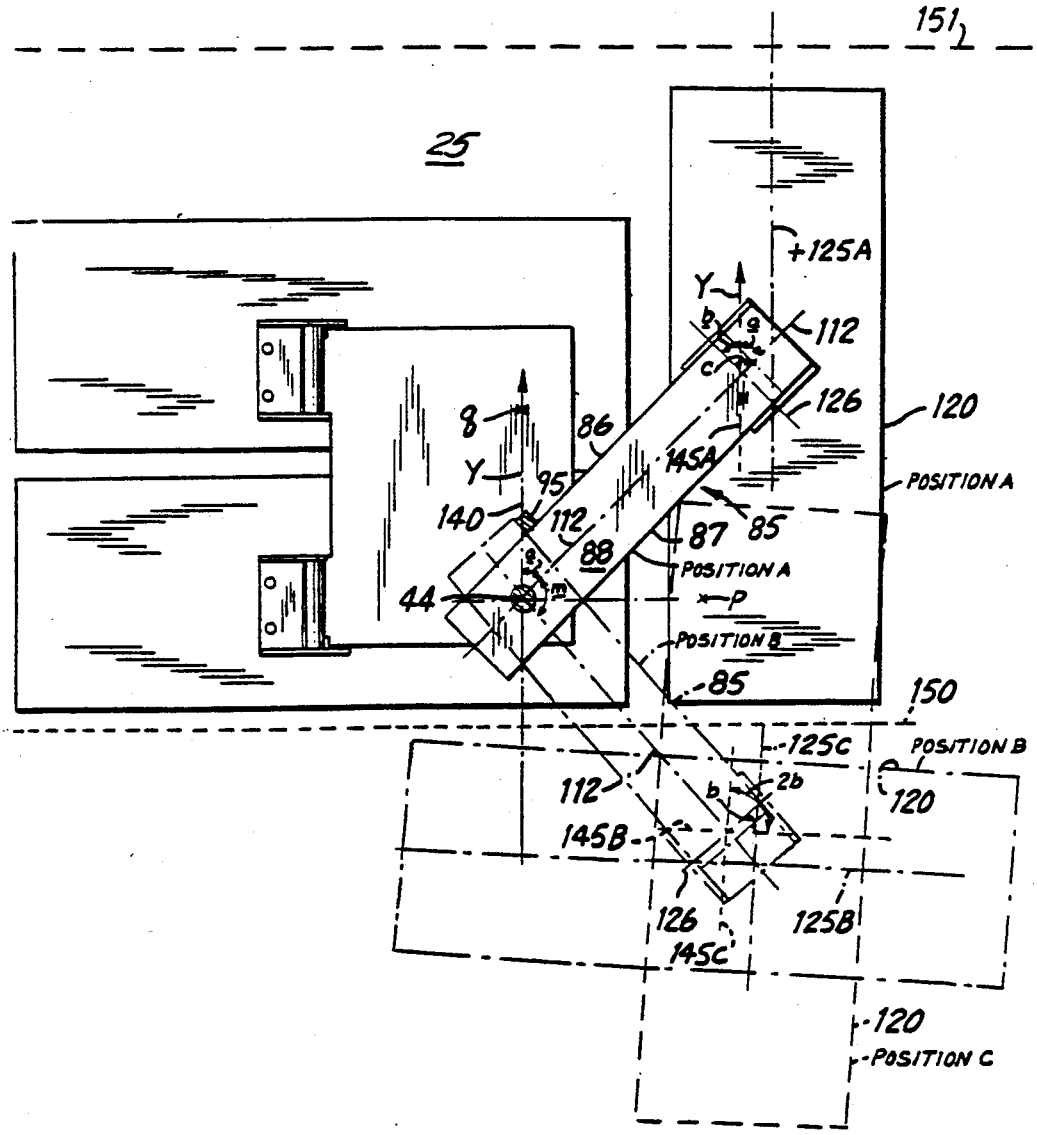
FIG. 5 is a schematic cross-sectional plan view, taken as indicated by the arrows 5—5 in FIG. 1 illustrative of the use of the FIG. 1, hanger installation.

Referring now particularly to FIGS. 1, 2 and 5, the initial condition of the hanger installation 10 is shown in FIG. 2. In that condition, all three of the binders 70, 70' and 105 have the stored positions shown in FIG. 2 in which the binders are suspended from the arms which carry them, fit into the storage space 25 beneath shelf 21 to be out of the way, and contact their respective bumpers with slight force to be stabilized in angular position. Torsion spring 100 (FIG. 4) urges the arm counterclockwise against stop 95, and the spring also urges arm 45 clockwise against stationary cam stop 53.

To obtain access to a directory in one of binders 70 and 70', binder 70 is manually grasped and pulled outward to rotate arm 45 counterclockwise about vertical axis 44 by about 90° to bring the arm to a position at which it is stopped from further counterclockwise rotation by cam 53. During this time, arm 85 is prevented by stop 95 from responding to the counterclockwise rotation of arm 45 to rotate counterclockwise beyond stop 95. Hence, the described counterclockwise rotation of arm 45 will be a forced rotation against the bias of spring 100 and will further wind the spring to increase the torque exerted thereby on arms 45 and 85. When arm 45 reaches its full outward position, the desired one of binders 70 and 70' is pivoted by hand out, up and over to the position at which it is supported from underneath by arm 45. At that position, the top end of the binder will rest on the top of shelf 21 and the binder, upon being opened, permits reading of the directory therein.

After the information wanted has been obtained from the directory, the binder is shut and pivoted outward, down and in to again become suspended from arm 45. That arm is then swiveled clockwise (with the aid of urging force from spring 100) to restore the binder to its shown FIG. 2 position and to bring the arm to its clockwise rotation limit established by cam stop 53.

Suppose now it is desired to read the directory contained in binder 120 suspended from arm 85 by moving such binder from its stored position shown in FIG. 2 to a position at which it is face-up and openable to permit such reading. From the description heretofore given, the effect of spring 100 on arms 85 and 45 in the course of such movement (and the subsequent return movement of binder 120 to stored position) will be self evident. The geometry involved in such movement of binder 120 is, however, of interest and will now be described in more detail.

Referring particularly to FIG. 5, the angles assumed by arm 85 and binder 120 are measured in terms of a polar coordinate system of which line 140 represents the Y coordinate and, further, is aligned with the width direction of the support shelf 21 and the storage space 25 beneath it. Initially, arm 85 is at an angle a to Y coordinate line 140 so that centerline 112 of the arm is angularly displaced from line 140 by an acute angle −a, the magnitude of such angle being a, and its sign being negative because the displacement is clockwise from Y. The centerline 125 of the spine 121 of binder 120 is, however, shown as being angularly displaced from centerline 112 by the acute angle +a. Accordingly, binder 120 in its initial stored position A is aligned with the Y line 140 and the width direction of shelf 121.

A reference line 145 is shown in FIG. 5 as being passed through horizontal hinge pin axis 126 at the center of hinge pin 111 in such manner that reference line 145 is parallel to the spine centerline 125 and remains so in the course of movement of binder 120. As is seen in FIG. 5, for the initial position A of binder 120, line 145 is parallel to the Y direction line 140 but makes an acute angle of −b with the axis 126.

From position A, the arm 85 is angularly displaced by swiveling through an angle of −m to the arm position B shown in dot-dash lines. That arm movement brings binder 120 to its position B shown in dot-dash lines. The binder at that position is still suspended from the arm, with reference line 145 continuing to be displaced from the hinge axis 126 by the acute angle of −b.

As the next step, however, binder 120 is pivoted outward, upward and over about hinge axis 126 (with arm 85 remaining in position B) so that the binder assumes position C in which it is face-up, with the top end of the binder resting on the top of shelf 21. In the course of such pivoting, reference line 145 rotates about axis 126 as the binder rotates between positions B and C so that the angle between that line and axis 126, in the horizontal plane through that axis, is an angle which changes from a value of −b to a value of +b. That is, the angular displacement of reference line 145 in such plane in the course of rotation of binder 120 from position B to position C is a displacement having a value of $+2b$.

Comparing such displacement with what happens to the spine centerline 125 in the course of the described binder pivoting movement, that centerline is spaced from the pivoting axis 126 by hanger 106 so that, as binder 120 pivots, the positions assumed by the centerline 125 do not intersect to form an angle. Instead, movement of the centerline 125 can be envisaged by postulating a geometric cylinder which has axis 126 as its axis and has a radius such that centerline 125 makes tangential contact with the cylinder, and which cylinder rotates with the binder. Evidently, centerline 125 will remain fixedly positioned in relation to such cylinder as it so rotates. This being so, it is evident that, while the various positions assumed by the centerline 125 do not intersect to form an angle, the projections of such positions in the mentioned horizontal plane will intersect to form angles, and the angular displacement undergone by such projections as the binder moves from position B to position C will be a displacement which, like that of reference line 145, has a value of $+2b$.

From what has been said, it is apparent that the total horizontal angular displacement undergone by binder 120 in moving from position A to position C is a displacement having an angular value of $-m+2b$. From this, it follows that, if angle b is made equal in magnitude to one-half of angle m, the total angular displacement of binder 120 becomes zero irrespective of the specific values of angles m, b, a and the angle c between hinge axis 126 and arm centerline 112. The advantage of having such total angular displacement equal zero is that then the positions of the spine centerline 125 at binder positions A and C will have parallel alignments so as to conserve the lengthwise dimension of the total space occupied by the binder, when in position A and then in position C. Moreover, if m is made equal to 90° and b made equal to 45°, such positions of centerline 125 will not only have parallel alignments but will overlap (i.e., be coincident with the same straight line) so as to conserve to the maximum the lengthwise dimension of such space. In the FIG. 5 geometry, that maximum advantage is substantially obtained since angle b is about 45°, and angle m is approximately 90°.

Assuming that the condition has been satisfied that the angular displacement $-m+2b$ has an angular value approximately equal to zero, there remains to be considered the best values for angles c and a. With respect to angle c, its value is not critical (i.e., it could depart from 90° to be, say, 30° or 60° ) but, because of mechanical considerations, it is preferable that angle c be a 90° angle. That is, it is better and easier mechanical design for hinge pin 111 (and, thus, its axis 126) to be at 90° to centerline 112 of arm 85 than at any other angle thereto. When angle c has a 90° value, it will be evident that angle b will have a value of $90-a$.

Turning now to angle a, the value of such angle can be selected to be within a fairly broad range. Evidently, however, angle a desirably has such value that, considering the geometry of the storage space 25 beneath shelf 21, binder 120 when stored in its position A in such space will fit in between the front and back boundaries 150 and 151 (FIG. 5) of such space. For the geometry of the embodiment shown in FIG. 5, that condition is well satisfied by an angle a of about 45°. For other geometries, however, angle a may have other values consonant with satisfying the condition mentioned. For example, if the swivel axis for arm 85 were not to be axis 44 but another axis located at say, point p (FIG. 5), and if the coupling of arm 85 to binder 120 were to remain at the place shown in FIG. 5, angle a would be rendered so small as to approach zero, and the distance of the arm between its swivel axis and hinge axis 126 would be shortened. Any seeming advantage obtained from such shortening would, however, be illusory because, with the swivel axis for arm 85 being at point p, the top of the binder 120 in moving between positions A and B would follow an arc displaced rightward from the arc followed by it in the FIG. 5 geometry, and such rightwardly displaced arc would require undesirable lengthwise expansion rightward of shelf 21 and the space beneath it in order for such top to clear the right enclosing wall 23 for space 25 as that binder top sweeps through such arc.

As another example, suppose the swivel axis for arm 85 were to be located at point q shown in FIG. 5 with binder 120 remaining undisplaced in the widthwise direction of space 25, and with the outer end of arm 85 being coupled as before to the binder. In that case, the value of angle a would be so large as to approach 90°, but the distance of arm 85 between its swivel axis at point q and the hinge axis 126 would have to be considerably lengthened to enable the arm to bring binder 120 outward of the shelf's front boundary 150 in the course of moving the binder from position A to position B. Such lengthening of arm 85 would be disadvantageous because it would also require rightward expansion of shelf 21 and the storage space 25 in order for the binder 120 on the free end of such lengthened arm to clear the right side wall 23 (FIG. 1) as the binder moves between those positions.

Thus, in respect to an appropriate value for angle a, it can properly be said that such angle should be closer to 45° than to either 0° or 90°. From this it follows that, using such criterion, the value of angle a preferably lies in the range between and including 22½° and 67½°.

As a final consideration, it will be apparent from FIG. 5 that the angular displacement of spine centerline 125 at position A of binder 120 has an angular displacement from Y direction line 140 which is equal to $-a+c-b$. Moreover, it is advantageous that such displacement be equal to zero since, in that case, the binder when in position A will take up the least space in the lengthwise direction in storage space 25. As stated, angle c preferably has a value of 90° such that angle b has a value of $90-a$. From this and from the consideration that the preferred range for angle a is between and including 22½° and 67½°, it follows that, when angle a is in that preferred range and angle c has its preferred value of 90°, the value of angle b must lie in the range between and including 22½° and 67½° in order to satisfy the condition that $-a+c-b$ equals zero. That range for angle b is, therefore, its preferred range.

The above-described embodiment being exemplary only, it will be understood that additions thereto, omissions therefrom and modifications thereof can be made without departing from the spirit of the invention, and that, accordingly, the invention should not be considered as limited save as is consonant with the scope of the following claims.

What is claimed is:

1. A printed matter hanger mechanism comprising a base securable to the underside of raised support means, first and second arms disposed beneath said base with the first arm being above the second arm, the projection of the axes of the arms forming angle with each other; and with the inner ends of both arms being vertically aligned so that a common verticle axis passes through both such ends, swivel means providing a coupling of such base with each of said arms so that they are independently pivotally movable horizontally about said axis, said swivel means comprising a vertical support shaft extending downward from said base, said vertical axis being the axis of said shaft, bearing means mounting the inner ends of said first and second arms on said shaft so that they are pivotally movable independently about said vertical axis while being constrained from movement in their other angular coordinates, a torsion spring disposed around said shaft and having opposite ends coupled to respectively said first and second arms for urging them to rotate in opposite directions around said shaft, and stop means positionally fixed in relation to said base and operable to set a limit to the rotation of each of said arms in the direction in which such arm is urged to rotate by such spring, first and second binders each comprising a spine and covers for printed matter, hinge means providing hinge couplings between said first and second binders and the outer ends of, respectively, said first and second binders are respectively rotatable about first and second horizontal axes at the outer ends of, respectively, said first and second arms and disposed transverse to the respective centerlines thereof, each of said binders being vertically movable by such rotation thereof between first and second positions about 180° apart and, at which, respectively, each binder is suspended from its corresponding arm and is supported from underneath by such arm and the centerline of one of said binders being at an angle with respect to the arm supporting said binder.

2. A mechanism according to claim 1 in which said stop means is further operable to set a limit to the rotation of each of said arms in the direction opposite to that in which such arm is urged to rotate by such spring.

* * * * *